US012241642B2

(12) United States Patent
DeRossett

(10) Patent No.: US 12,241,642 B2
(45) Date of Patent: Mar. 4, 2025

(54) APPARATUS AND METHOD OF RETENTION OF A WINDOW AIR CONDITIONING UNIT WITHIN A WINDOW ASSEMBLY

(71) Applicant: Midea Group Co., Ltd., Foshan (CN)

(72) Inventor: Andrew Q. DeRossett, Shelbyville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 259 days.

(21) Appl. No.: 18/068,386

(22) Filed: Dec. 19, 2022

(65) Prior Publication Data

US 2024/0200794 A1 Jun. 20, 2024

(51) Int. Cl.
*F24F 1/031* (2019.01)
*F24F 13/32* (2006.01)

(52) U.S. Cl.
CPC ..... *F24F 1/031* (2019.02); *F24F 13/32* (2013.01)

(58) Field of Classification Search
CPC .. F24F 1/027; F24F 1/031; F24F 13/32; F24F 2221/20
See application file for complete search history.

(56) References Cited

U.S. PATENT DOCUMENTS

| | | | |
|---|---|---|---|
| 399,491 | A | 3/1889 | Del piakko |
| 1,954,017 | A | 4/1934 | Manning |
| 2,234,753 | A | 3/1941 | Frazer |
| 2,268,451 | A | 12/1941 | Hull |
| 2,294,664 | A | 9/1942 | Hubbard |
| 2,320,436 | A | 6/1943 | Hull |
| 2,436,713 | A | 2/1948 | Cody |
| 2,472,792 | A | 6/1949 | Cohler |
| 2,568,968 | A | 9/1951 | Malcolm |
| 2,604,763 | A | 7/1952 | Lipman |
| 2,608,148 | A | 8/1952 | Shapiro |
| 2,708,833 | A | 5/1955 | Nigro |
| 2,814,244 | A | 11/1957 | Hord |
| 2,818,793 | A | 1/1958 | Hord |
| 2,925,026 | A | 2/1960 | Schuster |
| 2,935,284 | A | 5/1960 | Reeves |
| 3,030,873 | A | 4/1962 | Metcalfe |
| 3,134,319 | A | 5/1964 | Marsteller |

(Continued)

FOREIGN PATENT DOCUMENTS

| | | | |
|---|---|---|---|
| CN | 102455025 | A | 5/2012 |
| CN | 209689075 | U | 11/2019 |

(Continued)

OTHER PUBLICATIONS

Climaloc; "Top & Sides Door Seal Spring-Loaded Kit"; https://climalocsolutions.com/product/top-sides-door-sealspring-loaded-kit-2/; Climaloc; dated Nov. 2, 2022.

(Continued)

*Primary Examiner* — Joseph F Trpisovsky
(74) *Attorney, Agent, or Firm* — Gray Ice Higdon

(57) ABSTRACT

A retention bracket for a window air conditioning unit is disclosed, and more particularly, a retention bracket that pertains to securing a window air conditioning unit within a window assembly. The retention bracket may include a sliding mechanism. The retention bracket may include a biasing mechanism.

21 Claims, 9 Drawing Sheets

(56) References Cited

U.S. PATENT DOCUMENTS 3,271,972 A * 9/1966 Knight ..... F24F 1/04 62/262
3,318,226 A 5/1967 Ulich
3,476,033 A 11/1969 Appel
3,481,264 A 12/1969 Ulich
3,491,549 A 1/1970 Oglesby
3,552,470 A 1/1971 Metcalfe
3,554,476 A 1/1971 Gaylor
3,576,114 A 4/1971 Sharp et al.
3,698,208 A 10/1972 Williams
3,698,308 A 10/1972 Navara
3,861,283 A 1/1975 Shaner
3,911,803 A 10/1975 Kong
4,086,886 A 5/1978 Edmaier
4,152,844 A 5/1979 Gize
4,203,302 A 5/1980 Lapeyre
4,334,461 A 6/1982 Ferguson
5,027,614 A 7/1991 Mori
5,050,831 A 9/1991 Joyal
5,167,131 A 12/1992 Karkhanis
5,253,485 A 10/1993 Kennedy
5,290,343 A 3/1994 Morita
5,365,992 A 11/1994 Swain
5,582,025 A 12/1996 Dubin et al.
5,823,289 A 10/1998 Csomos
5,979,172 A 11/1999 Teller
5,979,533 A 11/1999 Dupuie
6,173,930 B1 1/2001 Arbucci
6,257,013 B1 7/2001 Murray
6,568,201 B1 5/2003 Cur et al.
6,767,278 B1 7/2004 Peterson
7,121,105 B1 10/2006 Rais
7,296,424 B2 11/2007 Thompson
7,332,019 B2 2/2008 Bias
7,350,759 B1 4/2008 Gray
7,753,334 B2 7/2010 Schreiber
7,854,141 B1 12/2010 Breen
7,975,441 B2 7/2011 Mccarriston
8,091,844 B1 1/2012 Bragg
8,104,240 B2 1/2012 McCarriston
8,578,728 B2 11/2013 Cho
8,584,998 B1 11/2013 Peterson
9,163,854 B2 10/2015 Arbucci
9,303,895 B1 4/2016 Grant
9,447,916 B2 9/2016 Darby
D782,289 S 3/2017 Darby
9,605,870 B2 3/2017 Darby
9,890,961 B1 * 2/2018 Sheldon ..... F24F 1/027
9,909,712 B1 3/2018 Darby
9,938,044 B2 4/2018 Gamboa
9,982,909 B1 5/2018 Perez et al.
10,203,130 B2 2/2019 Gardikis, Sr.
10,203,180 B2 2/2019 Miller
10,295,221 B2 5/2019 Zhang
10,359,212 B2 7/2019 Darby
10,401,043 B2 9/2019 Li
10,520,206 B2 12/2019 Xu
10,739,018 B2 8/2020 Baumann et al.
10,900,689 B2 1/2021 Weiner
11,168,920 B1 11/2021 Leezer et al.
11,397,023 B2 7/2022 Xing et al.
11,415,329 B2 8/2022 Liu et al.
11,441,791 B2 9/2022 Lei et al.
11,441,792 B2 9/2022 Liang et al.
2001/0032545 A1 10/2001 Goto
2003/0097854 A1 5/2003 Cur
2003/0110789 A1 6/2003 Cur
2005/0028545 A1 2/2005 Hebert
2006/0021359 A1 2/2006 Hur
2007/0023592 A1 2/2007 Makoso
2007/0068185 A1 3/2007 Thompson
2007/0107329 A1 5/2007 Ferrara
2007/0137237 A1 6/2007 Rais
2008/0053309 A1 3/2008 Woodruff
2008/0104989 A1 5/2008 Movshovitz
2010/0077924 A1 4/2010 Zhao
2010/0197214 A1 8/2010 Geremia, Sr.
2010/0229585 A1 9/2010 Bradford
2010/0326103 A1 12/2010 Stamm
2011/0040412 A1 * 2/2011 Wiese ..... F24F 13/18 700/275
2012/0137499 A1 6/2012 Agnihotri
2012/0274188 A1 11/2012 Shiborino
2013/0104581 A1 5/2013 Consoli
2013/0153744 A1 6/2013 Jin
2013/0327509 A1 12/2013 Michitsuji
2014/0020421 A1 1/2014 Gallo
2014/0076506 A1 3/2014 Olivas
2014/0090334 A1 4/2014 Darby
2014/0311063 A1 10/2014 McIntyre
2015/0034784 A1 2/2015 Darby
2015/0097096 A1 4/2015 Arbucci
2015/0211802 A1 7/2015 Yokozeki
2016/0033166 A1 2/2016 Hebert
2016/0097547 A1 4/2016 Selg
2017/0191763 A1 7/2017 Xu
2017/0284683 A1 10/2017 Gallo
2017/0297768 A1 10/2017 Gamboa
2017/0328596 A1 11/2017 Darby
2018/0023842 A1 1/2018 Gardikis, Sr.
2018/0149387 A1 * 5/2018 Darby ..... F24F 1/027
2018/0180305 A1 6/2018 Zhang
2019/0056143 A1 2/2019 Zhang
2019/0063760 A1 2/2019 Li
2019/0212032 A1 7/2019 Martinez Galvan
2020/0124296 A1 4/2020 Baumann
2020/0248911 A1 8/2020 Lei
2020/0333021 A1 10/2020 Martinez Galvan
2020/0363075 A1 11/2020 Bradford
2021/0010688 A1 1/2021 Biasotti et al.
2021/0078118 A1 3/2021 Li et al.
2021/0088251 A1 3/2021 Galvan et al.
2021/0164667 A1 6/2021 Yu et al.
2021/0180828 A1 6/2021 Xing
2021/0207819 A1 7/2021 Zhang et al.
2021/0222891 A1 7/2021 Rao et al.
2021/0325054 A1 10/2021 Zhao
2021/0341175 A1 * 11/2021 Leezer ..... F24F 13/32
2021/0355750 A1 11/2021 Liang et al.
2021/0356145 A1 11/2021 Lei et al.
2021/0356146 A1 11/2021 Zhang
2021/0404749 A1 12/2021 Wexler
2022/0057109 A1 2/2022 Leezer
2023/0026722 A1 1/2023 Yu
2023/0194123 A1 6/2023 Palomäki
2023/0375222 A1 11/2023 Leezer

FOREIGN PATENT DOCUMENTS

WO 2020038239 A1 2/2020
WO 2020228408 A1 11/2020

OTHER PUBLICATIONS

Mcnichols, Eret C., United States Patent and Trademark Office, Notice of Allowance issued in U.S. Appl. No. 18/230,562, 79 pages, dated Mar. 13, 2024.
Mcnichols, Eret C., United States Patent and Trademark Office, Notice of Allowance issued in U.S. Appl. No. 17/519,061, 40 pages, dated Apr. 13, 2023.
Home Depot; "How to Install a Window Air Conditioner"; retrieved from https://www.homedepot.com/c/ah/how-to-install-a-window-air-conditioner/9ba683603be9fa5395fab90e6808e44; retrieved on Nov. 2, 2022.
Related Applications Transmittal dated Jan. 5, 2023.
Mcnichols, Eret C., United States Patent and Trademark Office, Non-Final Office Action issued in U.S. Appl. No. 17/519,061, 18 pages, dated Sep. 30, 2022.

* cited by examiner

APPARATUS AND METHOD OF RETENTION OF A WINDOW AIR CONDITIONING UNIT WITHIN A WINDOW ASSEMBLY

BACKGROUND

Window installed air conditioning units are common home appliances nowadays. A traditional window air conditioning unit is typically placed on a mounting bracket on a horizontal windowsill when a window sash is open. The window sash is then partially closed to rest on the top surface of the unit outer casing, and the unit is typically attached rigidly to the window sash frame via a flange or a shroud to be affixed in the window opening. Such a "window-defined" enclosure for the traditional window air conditioning unit requires the window sash to remain in place and in contact with the top of the air conditioning unit at all times. Consequently, the window sash cannot be opened during times of the year when it is desired to get fresh air from outside, or whenever a user would prefer to open the window instead of running the air conditioning unit. Also, the window sash cannot be closed beyond the top of the window air conditioning unit, which means the noise generated by the window air conditioning unit outdoor component including the compressor and the fan is always a problem for consumers.

Embodiments herein disclose a new window air conditioning unit design that allows consumers to open or close the window after installation. Such embodiments also include a retention bracket reducing the risk of the unit falling/tipping, reduces the need for exterior mounting brackets, reduces installation time, and also permits a window sash to be raised and lowered by consumers.

SUMMARY

The present disclosure provides an improved retention bracket with advantages including, but is not limited to: ease of installation and adjustability to fit into various sized window openings; maintaining the appearance of the window air conditioning unit; avoiding the possible damages to the structure of the window sash and/or house exterior; and allowing for the window to be opened or closed after the window air conditioning unit is installed. The apparatus may also work with other similar industrial designs of window air conditioning units, achieving similar advantages as outlined above.

In some embodiments, a window air conditioning unit may include a housing having an indoor portion and an outdoor portion spaced apart from each other to define a window slot slidably receiving a window sash. In various embodiments, the unit may include a retention bracket configured to engage the window sash and move with the window sash between a first position and a second position, wherein the first position is at a higher elevation than the second position. In some embodiments, the bracket may not engage the glass of the window sash.

In addition, in some embodiments, the retention bracket may include a biasing mechanism urging at least the retention bracket towards the first position. In various embodiments, at least a portion of the retention bracket may be positioned in the window slot. In some embodiments, the retention bracket may include a sliding mechanism, wherein the sliding mechanism may slide the retention bracket vertically between the first position and the second position with the window sash. In various embodiments, the sliding mechanism may include one or more tracks engaging one or more slots. In some embodiments, the sliding mechanism may slide the retention bracket along the indoor portion. In various embodiments, the retention bracket may engage the window sash in the first position above the window slot. In some embodiments, the retention bracket may be affixed to the window sash via one or more fasteners. In various embodiments, the retention bracket may include at least one member projecting upwardly from a bottom wall.

In some embodiments, a window air conditioning unit may include a housing having an indoor portion and an outdoor portion spaced apart from each other to define a window slot slidably receiving a window sash. In various embodiments, the unit may include a retention bracket having a sliding mechanism with the housing, wherein the sliding mechanism slides the retention bracket between a first position and a second position relative to the window slot, the retention bracket is configured to receive the window sash and slide vertically with the window sash between the first position and the second position, wherein the first position is at a higher elevation than the second position.

In addition, in some embodiments, the retention bracket may include a biasing mechanism urging at least the retention bracket towards the first position. In various embodiments, the sliding mechanism may be one or more tracks slidably engaging one or more slots within the window slot. In some embodiments, the retention bracket may be configured to receive a bottom edge of the window sash. In various embodiments, the retention bracket may be positioned above at least one of the indoor portion and/or the outdoor portion in the first position. In some embodiments, the retention bracket may include at least one member upwardly projecting from a bottom wall to engage the window sash. In various embodiments, the sliding mechanism may slide the retention bracket along the indoor portion of the housing.

In some embodiments, a method of securing a window air conditioning unit in a window assembly, the window assembly having at least one vertically operable window sash, a horizontal windowsill, and two vertical side window tracks, the method may include providing a window air conditioning unit having a window slot therewithin separating an indoor portion from an outdoor portion and a retention bracket. In various embodiments, the method may include raising the window sash. In some embodiments, the method may include positioning the window air conditioning unit onto the windowsill. In various embodiments, the method may include engaging the window sash into the retention bracket when in a first position. In various embodiments, the method may include sliding the window sash and the retention bracket from the first position to a second position lower than the first position.

In addition, in some embodiments, the method may include affixing the retention bracket to the window sash. In various embodiments, the method may include biasing the retention bracket towards the first position. In some embodiments, the first position is when the window sash is outside the window slot and the second position is when the window sash is inside the window slot. In various embodiments, the first position is when the window sash is inside the window slot and the second position is when the window sash is inside the window slot.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present disclosure is provided in the following written description of various embodiments of the disclosure, illustrated in the accompanying drawings, and defined in the appended claims.

DETAILED DESCRIPTION

Figure 1:
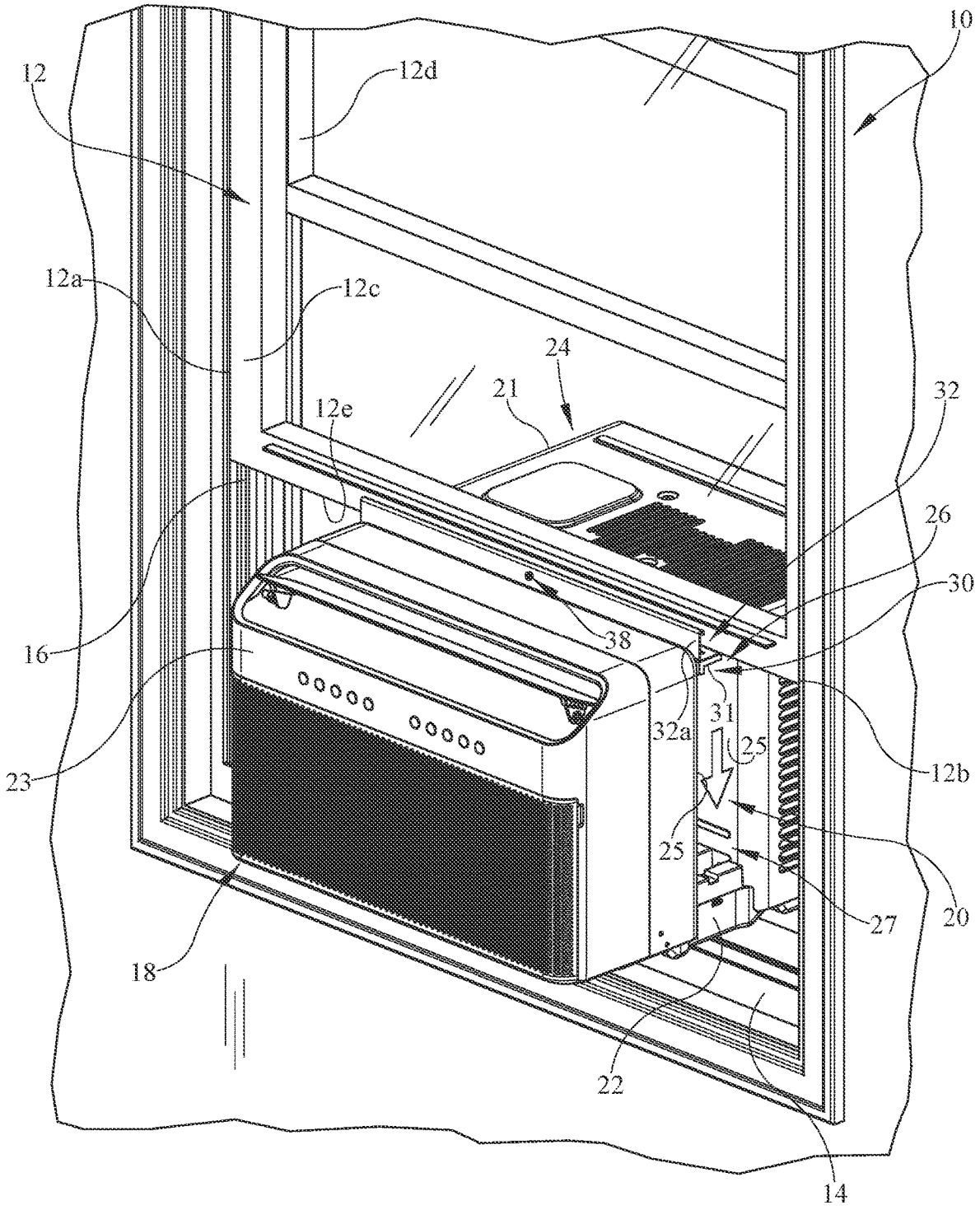
FIG. 1 is a perspective view of a window air conditioning unit installed using a retention bracket in accordance with various embodiments, viewed from the inside of a room with the window open or in at least one first position.

It is to be understood that a window air conditioning unit and/or retention bracket is not limited in its application to the details of construction and the arrangement of components set forth in the following description or illustrated in the exemplary drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to direct physical or mechanical connections or couplings.

Turning now to the drawings and in particular FIGS. 1-9, wherein like numbers denote like parts throughout the several views, one or more retention brackets 30 in accordance with various embodiments may be used for a window air conditioning unit 18 mounted in a window assembly 10. The type, size, and shape of the window air conditioning unit 18 may be varied while remaining within the scope of the present disclosure. In some embodiments, as shown in the FIGS. 1-9, the window air conditioning unit 18 may be U-shaped with a window slot 20 between an outdoor portion 21, which is disposed outside of a room, and an indoor portion 23, which is disposed inside of the room. The indoor portion 23 and the outdoor portion 21 may be spaced apart from each other to define a window slot 20 slidably receiving a window sash 12. The window slot 20 may allow the window assembly 10 to be closed (e.g. one or more second positions) into the overall casing structure 24 of the window air conditioning unit 18. The overall casing structure or housing 24 may be the outer casing perimeter adapted to enclose all the components of the window air conditioning unit 18, including but not limited to, the evaporator coil, the condenser coil, the compressor, the fan, the motor, etc. In the embodiments shown, the casing/housing 24 may include two main components; a casing for the indoor portion 23 and a casing for the outdoor portion 21. The indoor portion 23 and the outdoor portion 21 may define at least a portion of the window slot/groove 20. The window slot 20 may receive (e.g. slidably) the window sash 12 and/or retention bracket 30, or portions thereof. The window slot 20 may include a bottom wall or surface 22 and opposing side walls 25 of the indoor portion 23 and the outdoor portion 21, respectively, extending upwardly towards the top of the housing 24 (e.g. outdoor portion, indoor portion) and/or top opening 26. The opposing side walls 25 may face inwardly and away from the indoor portion 23 and outdoor portion 21. The window slot 20 may be U shaped with a top opening 26 connecting opposing lateral openings 27.

In some embodiments, as best shown in FIGS. 1, 2, 8, and 9 the window assembly 10 may include a vertically operable window sash 12, a horizontal windowsill 14, and a pair of vertical side window tracks 16 for slidably receiving the vertical side faces 12*a*, 12*b* of the window sash 12. Thus, the window sash 12 may be vertically slid up and down by a user within the window slot 20. The window sash 12 may include an indoor side/face 12*c* and an outdoor side/face 12*d* interconnecting the side faces 12*a*, 12*b* and bottom side/face 12*e*. Basically, any size window is acceptable, but ideally, the window assembly 10 may be a standard double hung window with a width of approximately 22 to 36 inches and a height of approximately 13.5 inches.

In some embodiments, the window air conditioning unit 18 may be installed upon the horizontal windowsill 14 of the window assembly 10 and the retention bracket 30 may help support the window air conditioning unit 18 within the window assembly 10. In some embodiments, the retention bracket 30 may be engaged to or disengaged from the window sash 12. The retention bracket 30 may engage/receive the bottom edge (e.g. one or more sides adjacent the bottom) of the window sash 12. For example, the retention bracket 30, or portion thereof, may engage the indoor side 12*c*, the outdoor side 12*d*, and/or bottom side 12*e* of the window sash. As shown in the one embodiment, the retention bracket 30 may engage at least the indoor side 12*c* and the bottom side 12*e* of the window sash 12. The retention bracket 30 may include one or more securement mechanisms or fasteners 38. One or more fasteners 38 (e.g. screw, bolt, clips), if used, may affix the retention bracket 30 (e.g. one or more portions thereof) to the window sash 12. For example, the fastener 38 may be affixed when the retention bracket 30 is in the first position engaging/receiving the window sash 12. The fastener may be affixed to the indoor side 12*c* as shown or to one or more portions of the window sash 12.

In some embodiments, there may be also at least one sealing member to close off the remaining gap between the lowered window sash 12, retention bracket 30, lateral sides of the bottom wall 22/housing 24, and/or the horizontal windowsill 14 after installation. The sealing member, if used, may be, for example, in an elongated rectangular configuration and made from material suitable for sealing window gaps, for example, foam. In some embodiments, the sealing member may be installed on both sides of the window air conditioning unit 18 or window slot 20.

Figure 3:
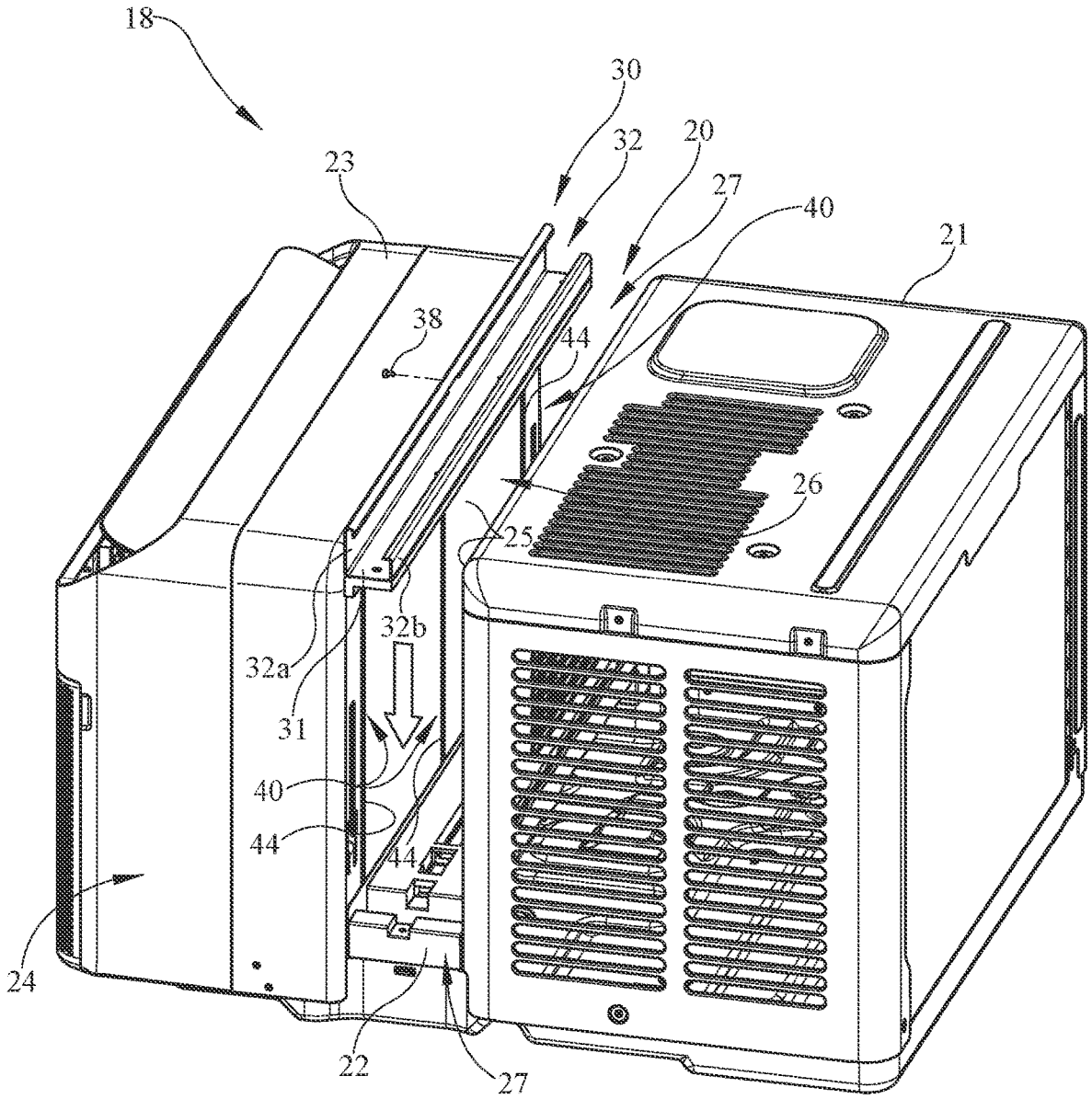
FIG. 3 is a top perspective view of the window air conditioning unit.
Figure 4:
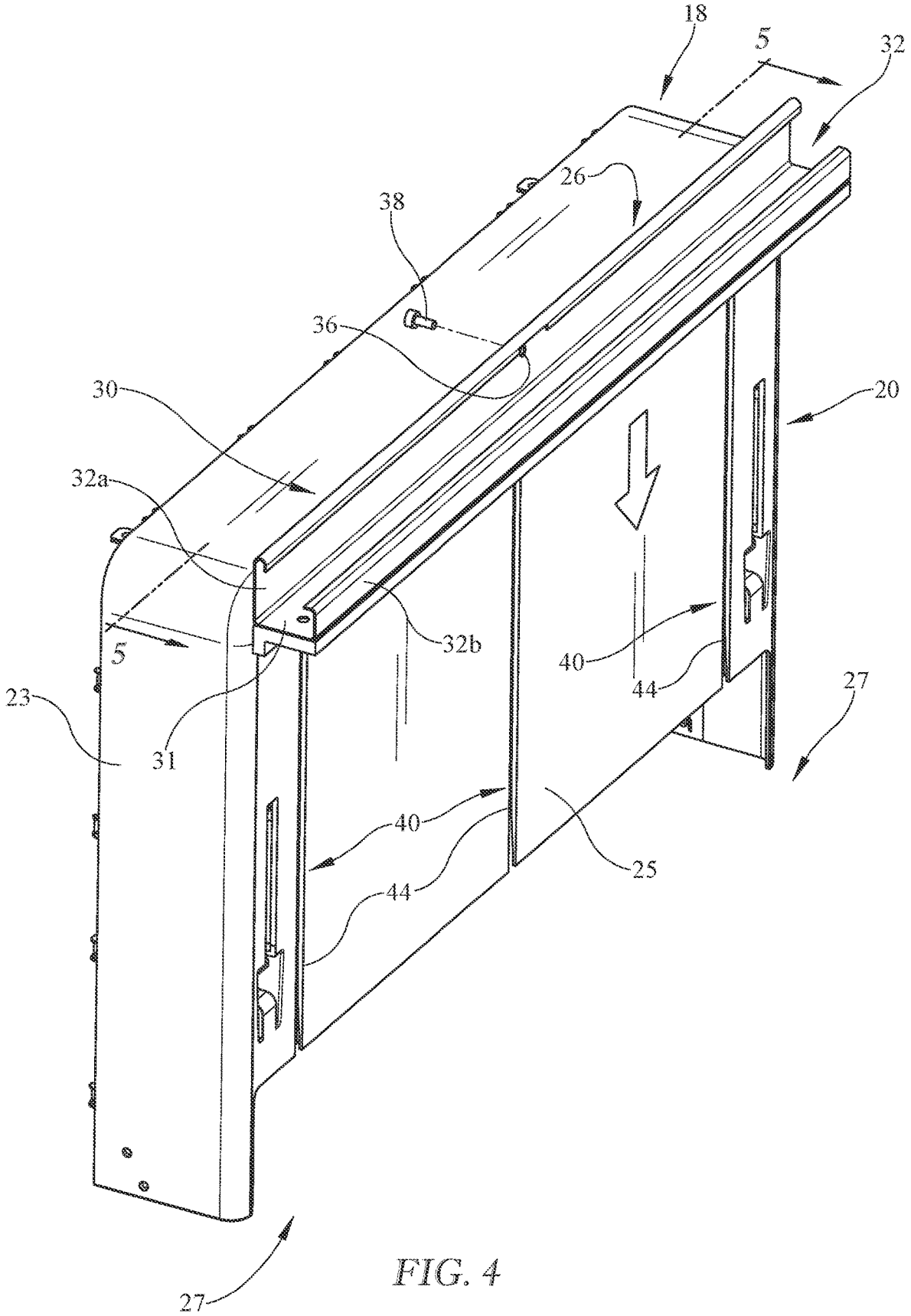
FIG. 4 is a partial perspective view of the embodiment of the retention bracket positioned in at least one first position in accordance of FIG. 1.
Figure 5:
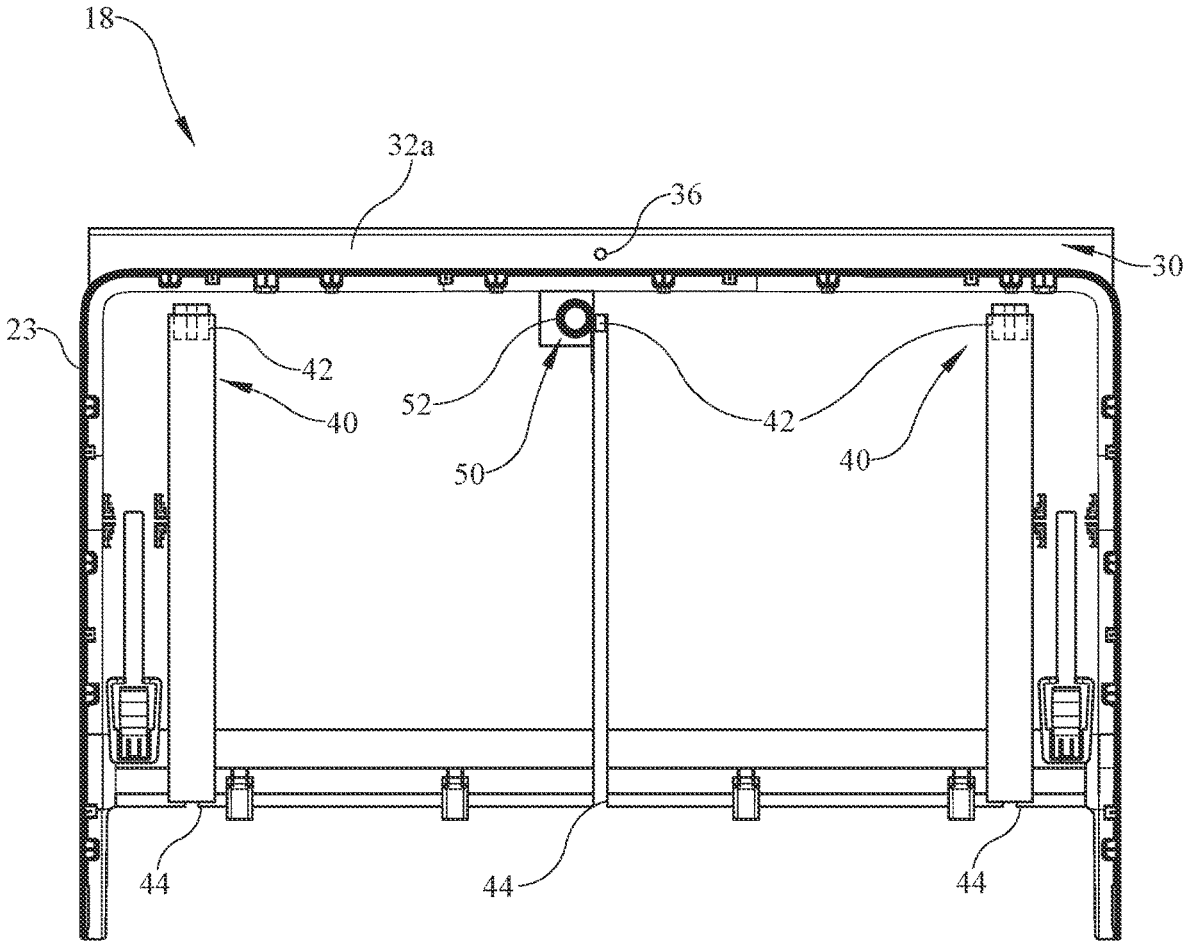
FIG. 5 is a sectional view taken along line 5-5 of FIG. 4.
Figure 6:
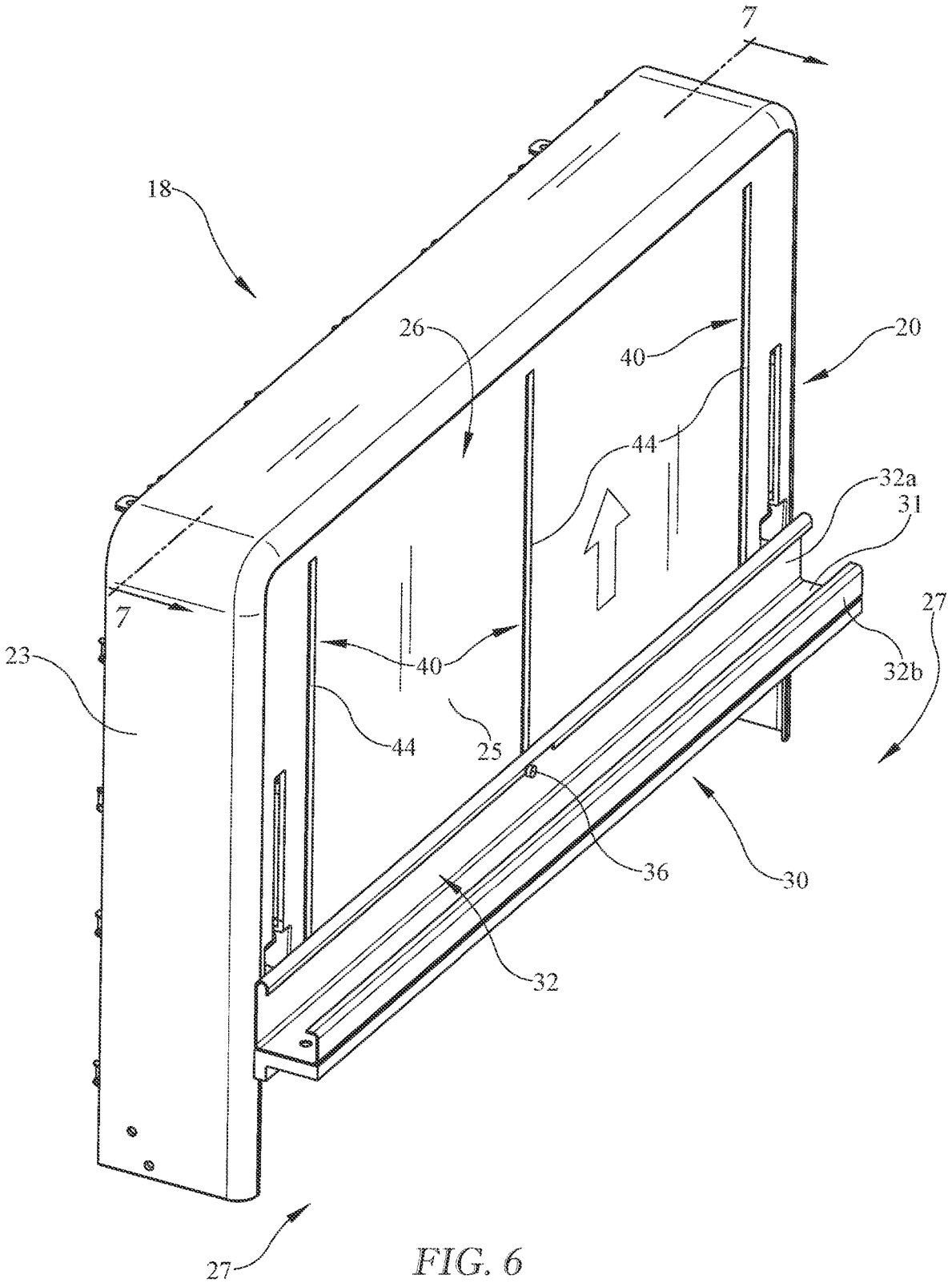
FIG. 6 is a partial perspective view of the one embodiment of the retention bracket positioned in at least one second position in accordance of FIG. 2.
Figure 7:
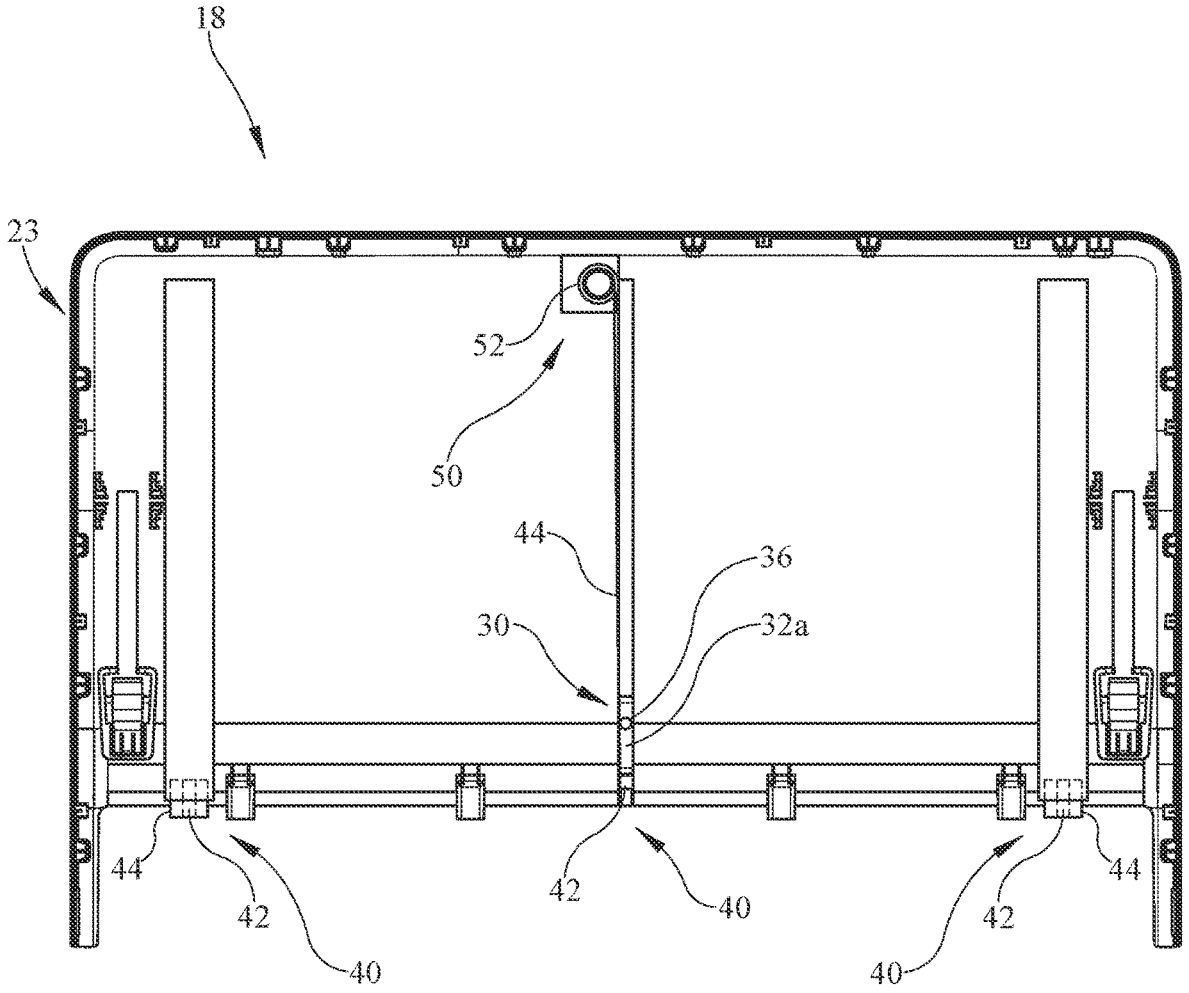
FIG. 7 is a sectional view taken along line 7-7 of FIG. 6.
Figure 8:
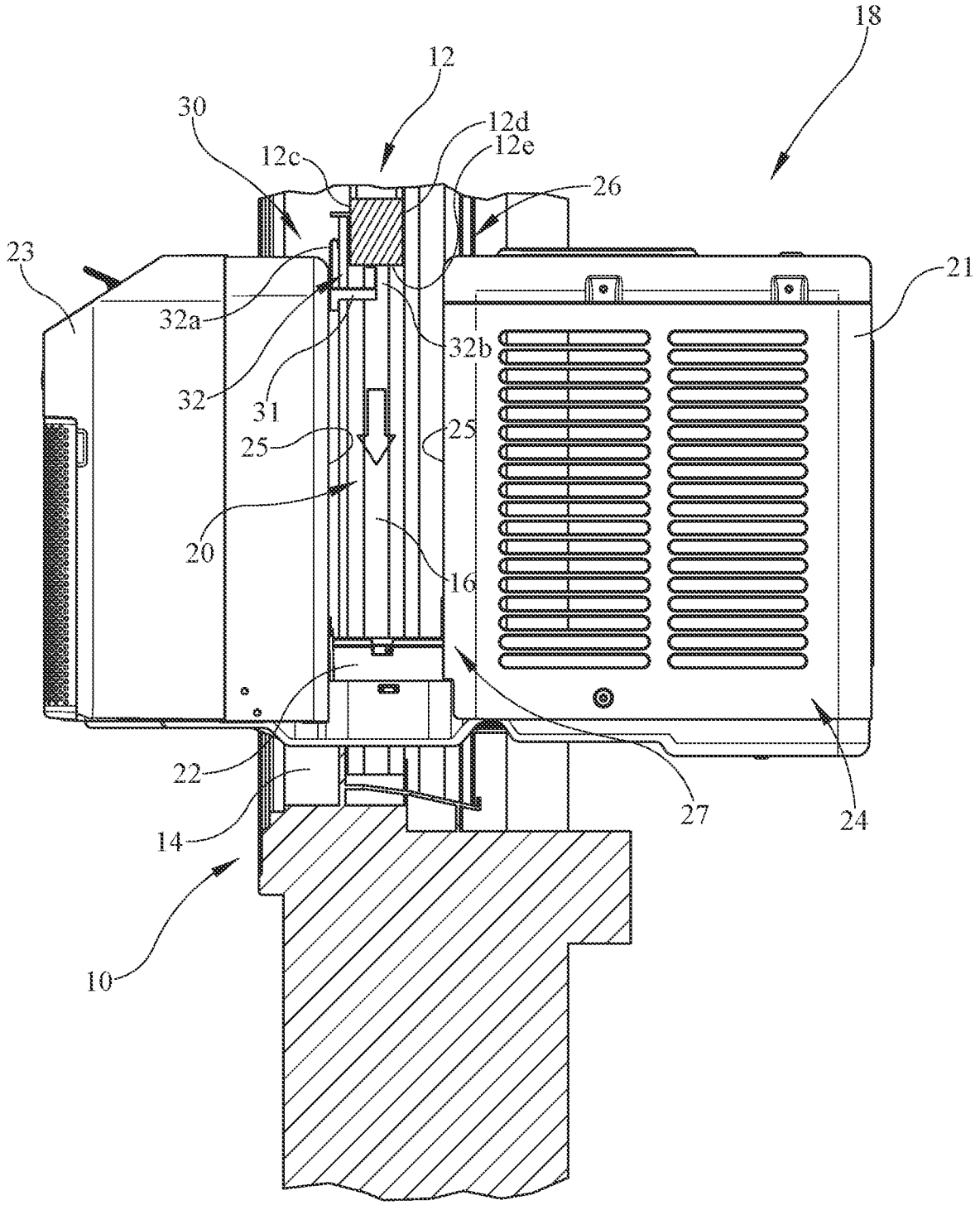
FIG. 8 is a side view of the apparatus of FIG. 1.
Figure 9:
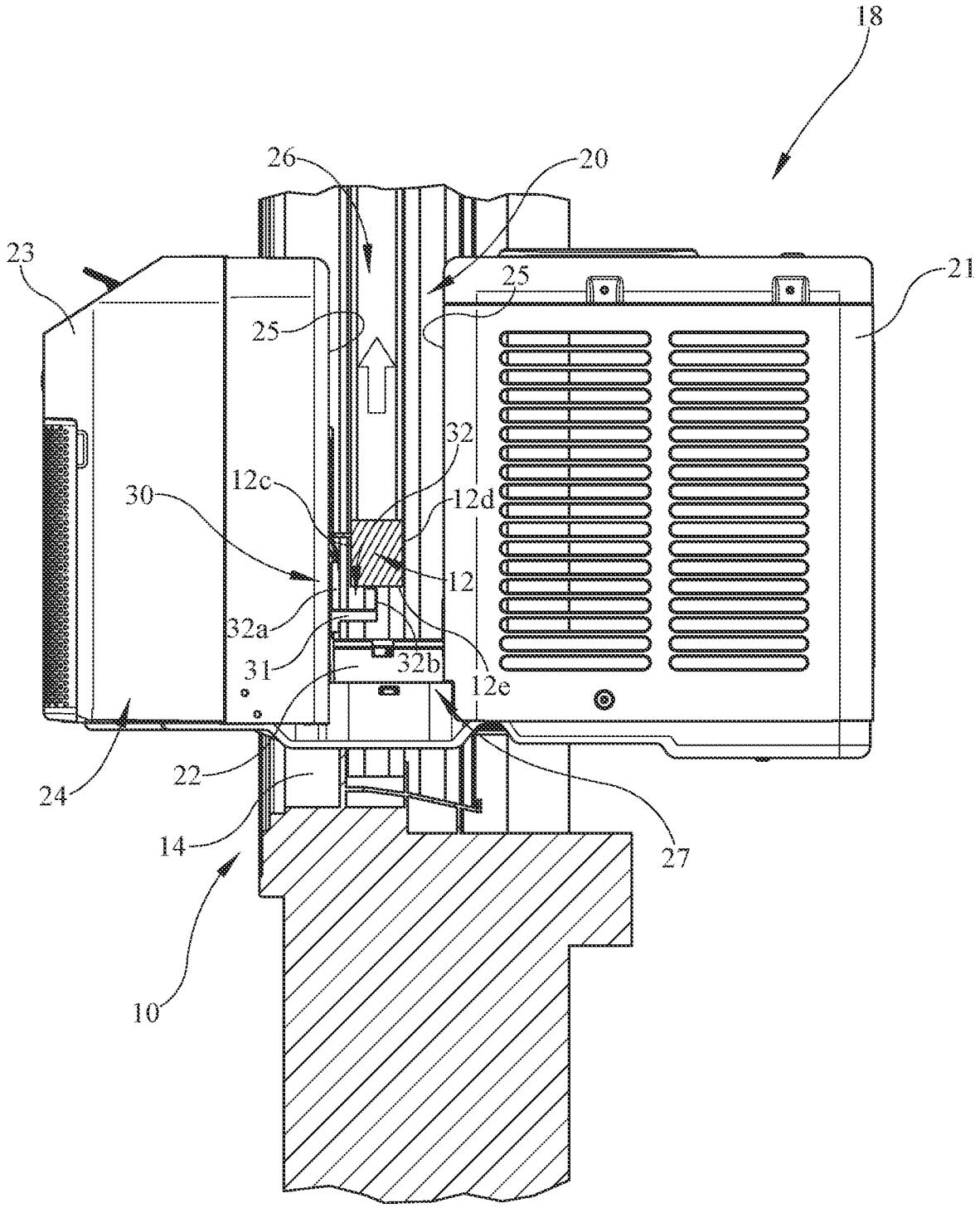
FIG. 9 is a side view of the apparatus of FIG. 2.

As mentioned above, the retention bracket 30 may be used to minimize the risk of the window air conditioning unit 18 falling or tipping from the window assembly 10 during installation, after installation, and/or removal due to external forces acting on the unit. FIGS. 3 and 4 illustrates the retention bracket 30 comprising one or more members. As shown in the one embodiment, the retention bracket 30 may be elongated in the horizontal direction in a variety of sliding/vertical positions (e.g. first, second, etc.). Although the retention bracket 30 is shown as a single construction, the retention bracket may include a plurality of pieces or parts, each having one or more members moving together or separately between positions. The retention bracket 30 is configured to engage the window sash 12 (e.g. bottom edge, bottom side, indoor side, and/or outdoor side) thereby reducing tipping, lateral movement, and/or the impact of external forces on the unit. The window sash 12 may be positioned on top of, received, or slid into engagement with the retention bracket 30, or portions thereof, at one or more elevations of the retention bracket 30 and/or window sash 12. The retention bracket 30 may include at least a member/wall 31 (e.g. bottom) that may engage the bottom side 12*e* of the window sash 12. The retention bracket 30 or bottom wall 31 may include one or more members (e.g. first 32*a*, second 32*b*) projecting upwardly therefrom. The one or more members (e.g. 32*a*, 32*b*) upwardly projecting from the bottom wall 31 may engage one or more portions of the window sash 12 (e.g. bottom side, one or more faces interconnected to the bottom side). The first member 32*a*, if used, may be adjacent the indoor side of the bottom wall 31. The second member 32*b*, if used, may be adjacent the outdoor side of the bottom wall 31. The retention bracket or members may be elongated and define a channel 32. Although the channel 32 and/or opposing ends of the bracket 30 are shown as open, in some embodiments the channel/end(s)s may be closed. The retention bracket 30, or portions thereof, may be positioned within the window slot 20 in one or more positions (e.g. first, second, etc.) thereof. The retention bracket 30 may be fabricated of, but is not limited to, an essentially rigid material, for example, an extruded metal such as steel or aluminum. The retention bracket 30, or portions thereof may include one or more sealing engagements/mechanisms to seal against the window sash. For example, as shown, the sealing engagement may be an elastic edge (e.g. curl, end) or gasket on one or more members (e.g. 32*a*, 32*b*), or portions thereof.

In some implementations, the retention bracket 30, or portions thereof, and/or window sash 12 may move/travel between at least one first position and at least one second position. The retention bracket 30 may move vertically relative to the housing 24 and/or window slot 20 of the window air conditioning unit 18. In the one embodiment shown, the retention bracket 30 slides or moves along the indoor portion 23 and/or window slot 20/housing 24. The first position, see FIG. 8, may be at a higher elevation than the second position, see FIG. 9. The retention bracket 30 may slide between the first position and the second position in a variety of positions/elevations therebetween or orientations. The retention bracket 30 may be orientated substantially horizontal when sliding/moving between different elevations/positions (e.g. first, second). Alternatively, other orientations may occur during movement or may be different in one or more positions. In the one embodiment shown, the first position of the retention bracket may be adjacent the top of the housing 24, top opening 26, and/or window slot 20. The retention bracket 30, or portions thereof, may project above the window slot 20 or opening 26 when in the first position. The retention bracket 30 may be positioned above at least one of the indoor portion 23 (e.g. housing) and/or the outdoor portion 21 (e.g. housing). In other embodiments, the retention bracket may be recessed (e.g. entirely, fully) vertically within the window slot 20 in one or more positions (e.g. first position, second position). In the second/closed position, the retention bracket 30 and the window sash 12 may be adjacent to or contact the bottom wall 22 or bottom of the window slot 20. The retention bracket 30 at a variety of positions (e.g. at least one first position) may engage the window sash 12 when it is in a variety of vertical sliding positions (e.g. at least one first position) in the window assembly 10. When engaged to each other, the retention bracket and the window sash may move (e.g. vertically, slidably) together between positions. For example, from the first position to the second position, and vice versa. The window sash 12 may drive the retention bracket 30 between positions or to a position in some embodiments. In other embodiments, the retention bracket 30 may drive the window sash 12 between positions or to a position. Although the retention bracket 30 is shown as flush or not extending outwardly from one or more lateral openings 27 of the window slot 20 in one or more positions (e.g. first position, second position), it should be understood that the bracket or one or more opposing ends may project outwardly from the one or more lateral openings 27 in one or more positions (e.g. first, second) in some embodiments.

In some implementations, the retention bracket 30 and/or window air condition unit 18 may include one or more sliding mechanisms 40, or portions thereof. The sliding mechanism 40 may allow the retention bracket 30 to move/slide between positions relative to the window air condition unit 18, or portions thereof. The sliding mechanism 40 may slide the retention bracket 30 and/or sash 12 along the indoor portion 23 or along/within the window slot 20. The sliding mechanism 40 may slide (e.g. vertically) the retention bracket 30 between two or more positions (e.g. first position, second position) with or without the window sash 12. The sliding mechanism 40 may be positioned between or interconnect the housing 24/indoor portion 23 and the retention bracket 30. In the one embodiment shown in FIGS. 3-7, the sliding mechanism 40 may be one or more tracks/tabs 42 (e.g. T shaped projections extending away from the bracket 30, or portions/members thereof) slidably engaging one or more slots 44 (e.g. vertical). In the one embodiment shown, the retention bracket 30 may include one or more tracks 42 and the housing 24/indoor portion 23/window slot 20 may include one or more slots 44. The sliding mechanism structure may be reversed between the retention bracket 30 and window slot 20/housing 24/indoor portion 23 in some embodiments. It should be understood that the sliding mechanism may be a variety of quantities, shapes, sizes, and constructions and still be with the scope of the invention. For example, rollers, rails, and/or slides may be used in some embodiments. Further, the sliding mechanism and/or bracket may be interconnected or slide along the outdoor portion 21 and/or indoor portion 23 in some embodiments.

In some implementations, the retention bracket 30, sliding mechanism 40, and/or window air conditioning unit 18 may include one or more biasing mechanisms 50. One or more biasing mechanisms 50, if used, may urge at least a portion of the retention bracket 30 and/or sliding mechanism 40 (e.g. track 42) towards (e.g. upwardly, vertically) the first position (See FIG. 5), top opening 26 of the window slot 20, top of the housing 24/window assembly 10, or portions thereof. The longer the window sash 12 and/or retention bracket 30 travels (e.g. downwardly, axially) towards the bottom of the window slot 20 or second position (See FIG. 7), the more force is applied by the one or more biasing mechanisms 50 to return the retention bracket 30 and/or sash 12 towards the first position or higher elevation. Although the one or more biasing mechanisms 50 may be a torsion spring 52 (e.g. clock spring) as shown in the one embodiment in FIGS. 5 and 7, it should be understood that the biasing mechanism may be a variety of shapes, sizes, quantities, and constructions and still be within the scope of the invention. For example, a compression spring may be used in some embodiments. Further, the force applied by the biasing mechanism could be a constant force as the window sash 12 and/or bracket 30 travels vertically. For example, the biasing mechanism may be a constant force spring in some embodiments.

In order to affix the retention bracket 30 to the window sash 12, or portions thereof, various securement arrangements/mechanisms (e.g. apertures, fasteners) may be provided. In some embodiments, the retention bracket 30, or portions thereof, may include one or more drilled or punched holes or slots/apertures 36 for anchoring one or more fasteners 38 through to affix the retention bracket 30 with one or more portions of the window sash 12. Apertures 36 may not be used in some embodiments. For example, a fastener 38 may be driven through one or more portions of the retention bracket, without one or more apertures, to affix to the window sash. In the one embodiment shown, one or more fasteners 38 may be used to affix the retention bracket 30 (e.g. member) to or with the window sash (e.g. indoor side 12*c*). The fasteners, if used, and/or apertures, if used, may be a variety of quantities, shapes, sizes, constructions, and positions within the retention bracket and still be within the scope of the invention. The fastener 38 may be a bolt or a screw of different sizes and types (e.g., slot, cross, hex, Philips, etc.). Various other fasteners are possible, including, for example, ball detents, movable pins, spring-loaded pins, posts, tongue-and-groove, and the like. In some embodiments, the fastener (e.g. bolt or the screw) may be factory pre-installed. It should be understood that the fastener 38 may be fastened tight to prevent inadvertent loosening of the retention bracket 30, or portions thereof.

With the retention bracket 30 installed, the window air conditioning unit 18 may bear its weight on the window assembly 10, or portions thereof, (e.g. against the window sash, windowsill, etc.). The retention bracket 30 thereof may provide a resistive support to the torque of the window air conditioning unit 18 biased thereagainst by the one or more retention brackets 30 affixed to or engaging one or more portions of the window assembly 10 or sash 12 when the window is in one or more positions (e.g. the open position, first position, closed position, and/or second position). With such a supportive arrangement, the window air conditioning unit 18 may still remain resting safely within the window assembly 10 when the window sash 12 and/or retention bracket 30 is lowered to "close the window". In this way, the noise level caused by the outdoor portion 21 including the compressor and the fan may be reduced with the window sash 12 working as a sound barrier between the outdoor portion 21 and the inside of the room. Also, the window sash 12 and/or retention bracket 30 may be raised to "open the window" to allow fresh air into the room, installation, and/or maintenance, etc. FIG. 1 shows the window assembly 10 and/or retention bracket 30 in a first position (e.g. the window sash 12 and/or bracket 30 is raised outside the window slot 20 and above the overall casing structure 22 of the window air conditioning unit 18, initially received within the window slot), and FIG. 2 shows the window assembly 10 and/or retention bracket 30 in a second position (e.g. the window sash 12 is lowered inside the window slot 20 with the retention bracket).

Having described the structural components of the retention bracket 30, a method of installation/securing will now be described. In some implementations, the method may include providing the retention bracket 30 and/or the window air conditioning unit 18. The method may include raising the window sash 12 to a first/open position to install the retention bracket 30 and/or window air conditioning unit 18 into or onto the window assembly 10. The window sash 12 may be positioned/slid/inserted into contact or against the retention bracket 30 and/or with the window slot 20. Alternatively, the bracket 30 may be positioned into contact or against the window sash 12 in a position (e.g. first). The retention bracket may engage the window sash 12 in a first position. The first position may be with the window sash entirely outside the window slot and/or retention bracket, or portions thereof, may be outside the window slot. In other embodiments, the window sash 12 or lower edge may be lowered in at least a portion of the window slot 20. If fasteners or other securement mechanisms 38 are used, the retention bracket 30 may be affixed to the window sash 12 in some embodiments. The user may adjust the vertical position of the engaged window sash 12 and retention bracket 30 from at least one first position to a lower at least one second position. The user may slide the window sash 12 and the retention bracket 30 from the first position to the second position that is lower than the first position. The sliding mechanism 40 may adjust the elevation or combined sash and bracket between two positions. The sealing member, if used, may be installed to close off the remaining gap between the lowered window sash 12, retention bracket 30, the horizontal windowsill 14, and/or remaining portion of the unit 18. The biasing mechanism 50, if used, may maintain the retention bracket in the first position or biased upwardly when engaging/affixing the window sash 12 with the retention bracket 30. The user may also raise the combined sash and bracket from the lower second position to one or more first positions to provide, but is not limited to, fresh air, maintenance, and/or additional steps of installing/removing. The biasing mechanism 50, is used, may assist the user in raising the window sash 12 and/or bracket upwardly towards the first or another position.

Upon the completion of the installation, the window air conditioning unit 18 is now secured within the window assembly 10 via the one or more retention brackets 30. With the retention bracket 30 properly installed, the window assembly 10 or sash 12 may be adjusted between the first position and the second position without disturbing the window air conditioning unit 18.

Figure 2:
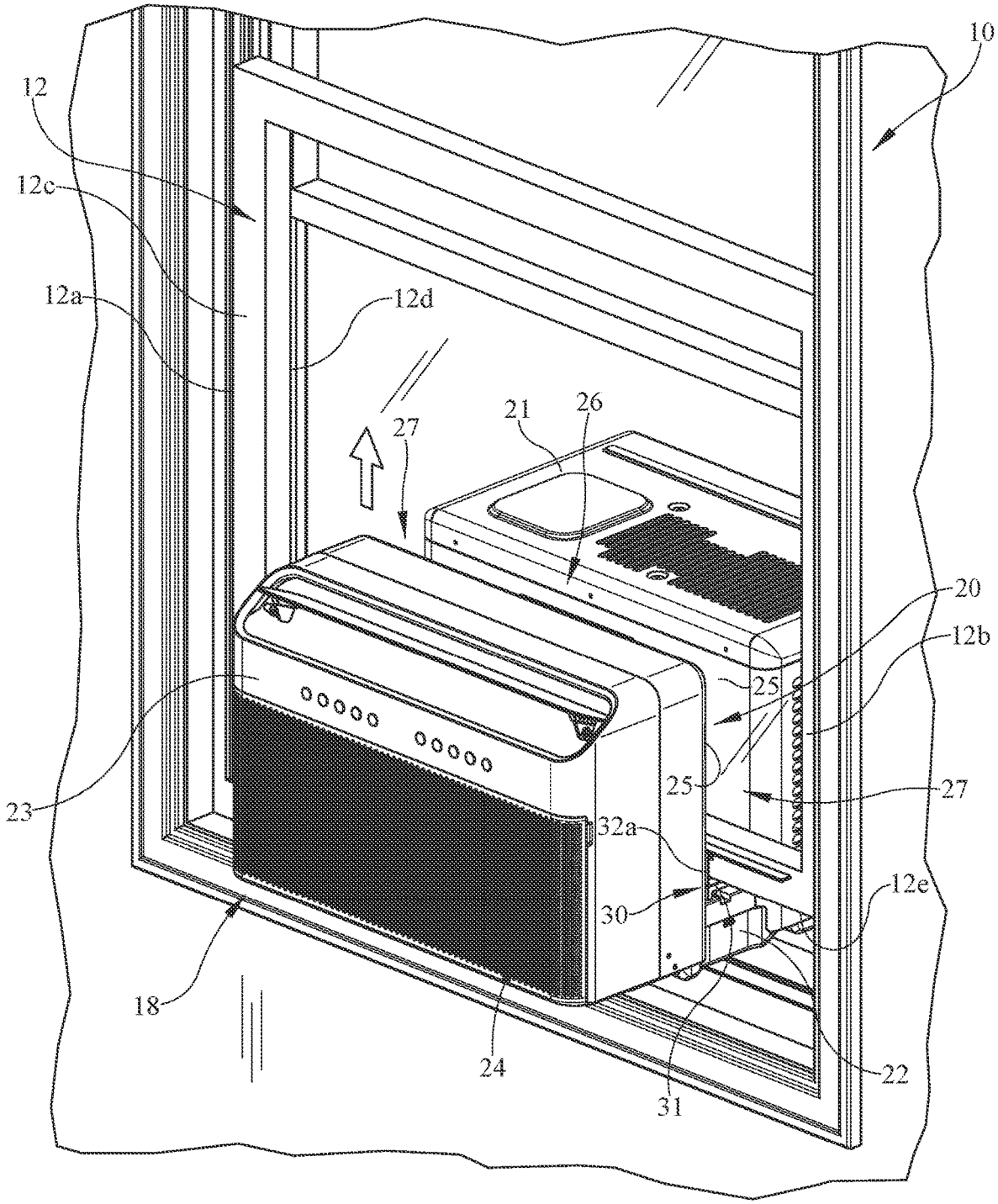
FIG. 2 is a perspective view of the apparatus of FIG. 1, illustrating when the window is closed or in at least one second position.

In some embodiments, the first position of the window assembly 10 may be when the window sash 12 and/or bracket is raised outside/adjacent the top opening 26 of the window slot 20 and/or above the overall casing structure of the window air conditioning unit 18, as shown in FIG. 1, and the second position of the window assembly 10 may be when the window sash 12 and/or bracket is lowered inside the window slot 20 and rests on the top or surface of the bottom wall or window slot, as shown in FIG. 2.

In some embodiments, after placing the window air conditioning unit 18 on the top of the windowsill 14, the window sash 12 may be pulled down into the window slot 20 and/or bracket 30 to help to align the window air conditioning unit 18 in the correct location. The window sash 12 inserted/engaged into the window slot 20/bracket 30 and/or portions of the window slot 20 may also help to support or reduce tipping of the window air conditioning unit 18 during installation, removing, maintenance, etc. Further, the fastener, if used, may be affixed when the window sash 12 and/or retention bracket is pulled down into the window slot.

Although not shown, in some implementations the retention bracket 30, or portions thereof, may not be integral with one or more portions of the window air conditioning unit 18, or portions thereof.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein, unless characterized otherwise, are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the disclosure to the precise steps and/or forms disclosed, and obviously many modifications and variations are possible in light of the above teaching. It is intended that the scope of the disclosure and all equivalents be defined by the claims appended hereto.

The invention claimed is:

1. A window air conditioning unit comprising:

a housing having an indoor portion and an outdoor portion spaced apart from each other to define a window slot slidably receiving a window sash; and a retention bracket configured to engage the window sash and move with the window sash between a first position and a second position, wherein the first position is at a higher elevation than the second position.

2. The unit of claim 1 wherein the retention bracket includes a biasing mechanism urging at least the retention bracket towards the first position.

3. The unit of claim 1 wherein at least a portion of the retention bracket is positioned in the window slot.

4. The unit of claim 1 wherein the retention bracket includes a sliding mechanism, wherein the sliding mechanism slides the retention bracket vertically between the first position and the second position with the window sash.

5. The unit of claim 4 wherein the sliding mechanism includes one or more tracks engaging one or more slots.

6. The unit of claim 4 wherein the sliding mechanism slides the retention bracket along the indoor portion.

7. The unit of claim 1 wherein the retention bracket engages the window sash in the first position above the window slot.

8. The unit of claim 1 wherein the retention bracket is affixed to the window sash via one or more fasteners.

9. The unit of claim 1 wherein the retention bracket includes at least one member projecting upwardly from a bottom wall.

10. A window air conditioning unit comprising:

a housing having an indoor portion and an outdoor portion spaced apart from each other to define a window slot slidably receiving a window sash; and a retention bracket having a sliding mechanism with the housing, wherein the sliding mechanism slides the retention bracket between a first position and a second position relative to the window slot, the retention bracket is configured to receive the window sash and slide vertically with the window sash between the first position and the second position, wherein the first position is at a higher elevation than the second position.

11. The unit of claim 10 wherein the retention bracket includes a biasing mechanism urging at least the retention bracket towards the first position.

12. The unit of claim 10 wherein the sliding mechanism is one or more tracks slidably engaging one or more slots within the window slot.

13. The unit of claim 10 wherein the retention bracket is configured to receive a bottom edge of the window sash.

14. The unit of claim 10 wherein the retention bracket is positioned above at least one of the indoor portion and/or the outdoor portion in the first position.

15. The unit of claim 10 wherein the retention bracket includes at least one member upwardly projecting from a bottom wall to engage the window sash.

16. The unit of claim 10 wherein the sliding mechanism slides the retention bracket along the indoor portion of the housing.

17. A method of securing a window air conditioning unit in a window assembly, the window assembly having at least one vertically operable window sash, a horizontal windowsill, and two vertical side window tracks, the method comprising:

providing a window air conditioning unit having a window slot therewithin separating an indoor portion from an outdoor portion and a retention bracket;

raising the window sash;

positioning the window air conditioning unit onto the windowsill;

engaging the window sash into the retention bracket when in a first position; and sliding the window sash and the retention bracket from the first position to a second position lower than the first position.

18. The method of claim 17 further comprising affixing the retention bracket to the window sash.

19. The method of claim 17 further comprising biasing the retention bracket towards the first position.

20. The method of claim 17 wherein the first position is when the window sash is outside the window slot and the second position is when the window sash is inside the window slot.

21. The method of claim 17 wherein the first position is when the window sash is inside the window slot and the second position is when the window sash is inside the window slot.

* * * * *